United States Patent [19]

Gärtner

[11] 4,230,413

[45] Oct. 28, 1980

[54] MECHANICAL PENCIL HAVING COLLET GUIDE

[75] Inventor: Jürgen Gärtner, Nüremberg, Fed. Rep. of Germany

[73] Assignee: J. S. Staedtler, Nüremberg, Fed. Rep. of Germany

[21] Appl. No.: 843,274

[22] Filed: Oct. 18, 1977

[30] Foreign Application Priority Data

Oct. 29, 1976 [DE] Fed. Rep. of Germany ..... 2649871

[51] Int. Cl.[3] ..... B43K 21/16; B43K 21/22

[52] U.S. Cl. ..... 401/65; 401/67; 401/87; 401/93; 401/94

[58] Field of Search ..... 401/65, 92, 93, 94, 401/65, 67, 53, 80, 87, 85; 403/348

[56] References Cited

U.S. PATENT DOCUMENTS

| | | | |
|---|---|---|---|
| 2,427,648 | 9/1947 | Farrington | 401/65 |
| 2,525,229 | 10/1950 | Lynn | 401/85 X |
| 3,088,439 | 5/1963 | Van Dersal | 401/82 |
| 3,350,119 | 10/1967 | Friedenreich et al. | 403/348 |
| 3,424,535 | 1/1969 | Schischkow | 401/53 |
| 3,537,799 | 11/1970 | Sakamoto | 401/67 |
| 3,765,781 | 10/1973 | Hashimoto et al. | 401/67 |
| 3,813,175 | 5/1974 | Katz | 401/67 X |
| 3,836,264 | 9/1974 | Saito et al. | 401/65 |
| 3,922,098 | 11/1975 | Katz | 401/94 |

FOREIGN PATENT DOCUMENTS

| | | | |
|---|---|---|---|
| 75601 | 12/1893 | Fed. Rep. of Germany | 401/94 |
| 666821 | 10/1936 | Fed. Rep. of Germany | 401/65 |
| 1022122 | 1/1958 | Fed. Rep. of Germany | 401/94 |
| 2447234 | 4/1975 | Fed. Rep. of Germany . | |
| 2240830 | 3/1975 | France | 401/94 |
| 525355 | 8/1940 | United Kingdom | 403/348 |

*Primary Examiner*—Steven A. Bratlie

*Attorney, Agent, or Firm*—Toren, McGeady and Stanger

[57] ABSTRACT

A mechanical pencil of the type in which a lead is gripped in a collet clamped about the lead by engagement between cooperating conical faces of a clamping ring and respective movable ends of two elongated collet members which form the collet and pass through the ring. The collet members are connected together at their other ends. The pencil is readily disassembled and assembled because the movable ends, when in the clamping position, are shaped to interfit with the bore of the ring, so as to permit passage of the collet through the ring in one angular position of the collet relative to the ring while preventing such passage except for limited axial movementin another angular position. Cooperating guide elements on the collet and ring hold the collet in the another angular position. A tubular closure member is releasably fastened to the barrel, and in the another position the collet can be axially displaced relative to the ring when the closure member is released.

4 Claims, 5 Drawing Figures

Fig. 1
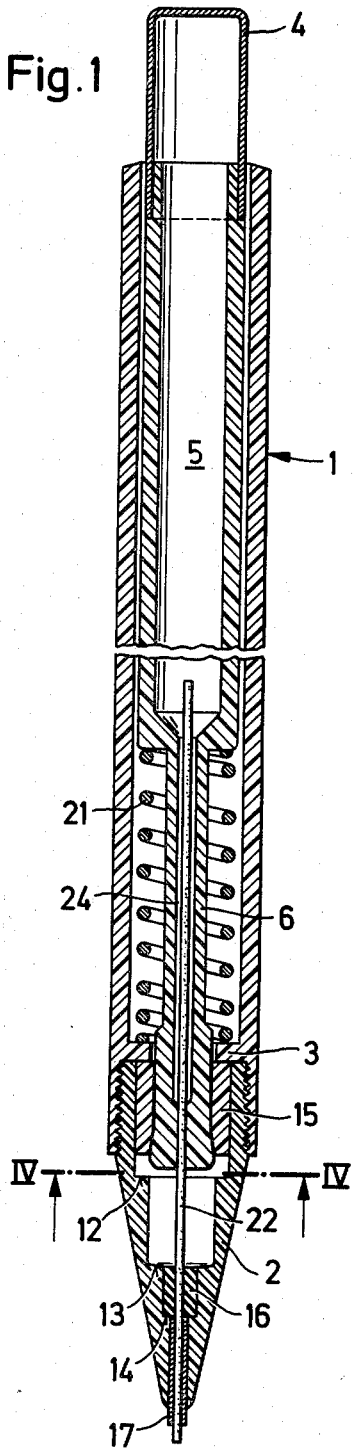
Fig. 4
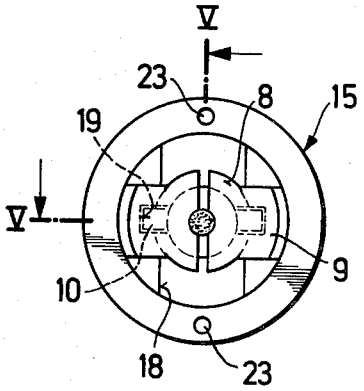
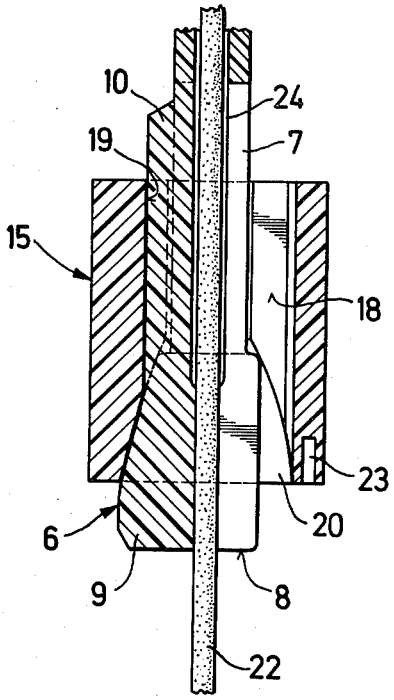
Fig. 5

MECHANICAL PENCIL HAVING COLLET GUIDE

This invention relates to mechanical pencils, and particularly to a mechanical pencil of the type in which a lead is gripped between two collet members and advanced by the collet members which are axially movable in the barrel of the pencil.

The invention is particularly concerned with an improvement in a pencil of the general type described in which respective first terminal portions of the collet members are fixed or integrally fastened to each other while second terminal portions are movable toward and away from a clamping position and are moved toward the clamping position during axial movement of the collet members in the barrel by engagement of respective axially flaring faces of the collet members and a similarly flaring inner face of a clamping ring capable of being secured against axial movement.

Pencils having unitary multiple collet members are advantageous in that they have fewer parts than pencils having individually movable collet members, but this advantage is at least partly compensated by more complex manipulative procedures necessary for assembling the pencil or for disassembling it for servicing or repair.

It is a primary object of this invention to provide a mechanical pencil having integrally connected collet members which pencil is capable of being assembled in a manner so simple that it may readily be mechanized.

With this object and others in view, the pencil of the invention has a tubular barrel having an axis and two axial ends. A collet in the barrel includes a plurality of axially elongated collet members having each a first, axially terminal portion fixedly fastened to the first portion of each other collet, and a second axially terminal portion transversely movable toward and away from a clamping position contiguously adjacent the second portion of each other collet member. The second portions of the collet members are jointly of a non-circular cross section and flare in the axial direction when in the clamping position. In that position, the collet members are dimensioned for clamping an axially elongated lead therebetween. An actuating mechanism, accessible outside the barrel, permits the collet to be moved axially. A clamping ring in the barrel is formed with an axial bore having a portion of non-circular cross section and receiving the collet members. The non-circular bore portion is dimensioned for passage of the second collet member portions through the ring in a first angular position of the collet and the ring relative to the barrel axis while preventing such passage in a second angular position of the collet and ring. An orifice of the bore in the clamping ring flares in the same direction as the combined second collet portions so that the second portions, when abuttingly received in the orifice are held in their clamping position when in a predetermined axial position and the afore-mentioned second angular position. Cooperating guide elements on the collet and on the clamping ring secure the collet in its second angular position during movement from the predetermined axial position out of the orifice over a first distance while permitting movement from the second to the first angular position at a second distance from the predetermined axial position.

Other features, additional objects, and many of the attendant advantages of this invention will readily be apparent as the same becomes better understood by reference to the following detailed description of a preferred embodiment when considered in connection with the appended drawing in which:

FIG. 1 shows a mechanical pencil of the invention in elevational section on the axis of its barrel and in its normal writing condition;

FIG. 4 is a greatly enlarged plan view of elements of the pencil taken on the line IV—IV in FIG. 1; and FIG. 5 shows the device of FIG. 4 in section on the line V—V.

Figure 2:
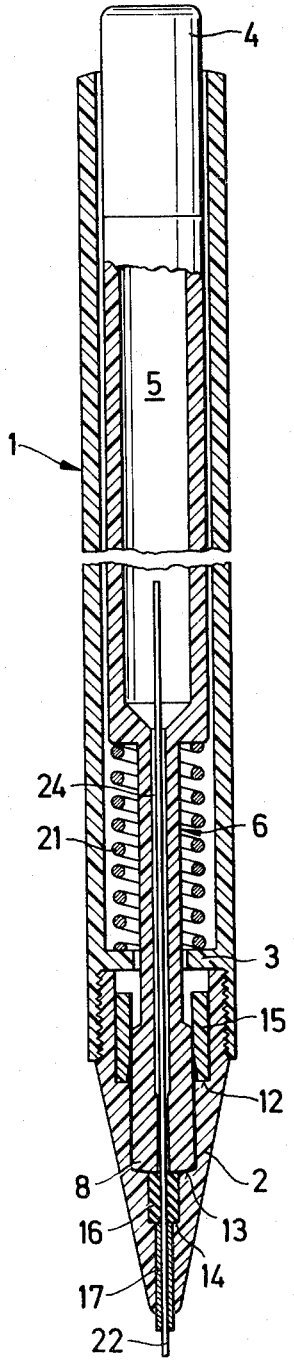
FIG. 2 shows the pencil of FIG. 1 during forward feeding of its lead.

Referring now to the drawing in detail, and initially to FIG. 1, the illustrated pencil has a plastic barrel 1 of generally cylindrical shape. A conically tapering, tubular front piece 2 is mounted on internal threads in one axial end of the barrel 1, hereinafter referred to as the front end, and is axially secured by abutting engagement with an internal, integral collar 3 of the barrel. A metallic pushbutton 4 having the shape of an inverted cup projects from the rear end of the barrel 1.

Figure 3:
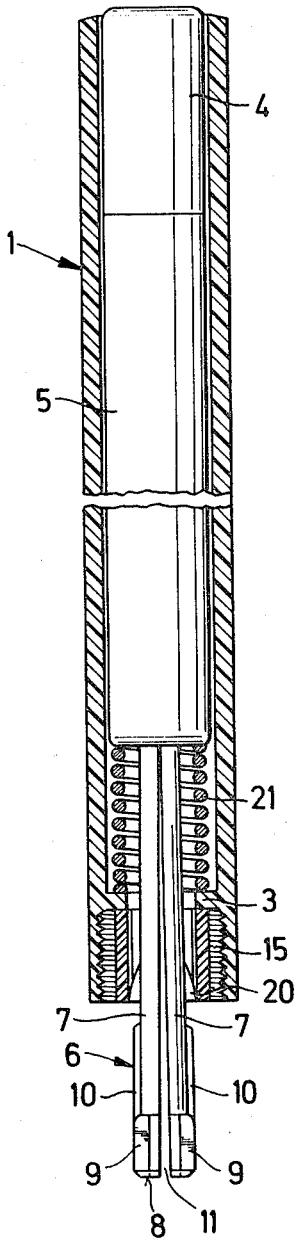
FIG. 3 illustrates the pencil in the partly disassembled condition.

The pushbutton is mounted with a friction fit on the matingly reduced rear end of a tubular plastic storage receptacle 5 which is axially slidably received in the bore of the barrel 1. A clamping collet 6, integrally molded with the receptacle 5 extends from the receptacle toward the front piece 2. The collet 6 is slotted over its entire length along the longitudinal axis of the barrel 1, as is better seen in FIG. 3. Each half of the collect 6 has a semi-cylindrical main portion 7. Its free end 8 is radially enlarged and carries an integral, axially elongated projection 9 which flares conically in front end direction. The main portion 7 carries an axially elongated rib 10, circumferentially narrower than the projection 9 and axially aligned with the projection, as is shown in detail on a larger scale in FIGS. 4 and 5. The resiliency of the plastic material tends to spread the collet halves so that they bound a slot 11 when not confined, as is shown in FIG. 3.

The bore of the front piece 2 is of stepped cylindrical shape, the several axial sections of the bore being separated by shoulders 12, 13, 14. The widest innermost portion of the bore bounded by the collar 3 and the shoulder 12 slidably receives a plastic clamping ring 15 whose outer face is cylindrical. The portion of the bore between the shoulders 12, 13 is equal in cross section to the central opening in the collar 3 and capable of receiving the enlarged free ends 8 of the collet 6 when the collet 6 is radially expanded. The next section of the bore between the shoulders 13, 14 contains a fixedly mounted rubber tube 16. A thin metal tube 17 lines the outermost section of the bore, and its tip projects outward of the bore.

The axial rear part of the bore in the ring 15 is bounded by two flat faces 18 whose spacing is slightly greater than the width of the projections 9, as is best seen in FIGS. 4 and 5. Central, axial grooves 19 in the faces 18 are dimensioned for a sliding fit with respective ribs 10. The wide gap between the faces 18 and the grooves 19 in the faces 18 merge with a conically flaring, front orifice 20 of the ring 15. In the relative angular position of the ring 15 and the collet 6 illustrated in FIGS. 1, 4, and 5, the ribs 10 are received in the grooves 19, and hold the projections 9 at right angles from a position in which they could pass between the faces 18. A helical compression spring 21 is coiled about the main portions 7 of the collet 6 and is axially confined between an annular, radial face of the receptacle 5 about the root of the collet 6 and the collar 3 of the barrel, thereby biasing the collet 6 rearward as far as abutting engagement between the projections 9 and the conical walls of the orifice 20 permits.

A lead 22 extends from the interior of the receptacle 5 forward slightly beyond the tip of the metallic guide tube 17. It passes through an oversized bore in the radial end wall of the receptacle 5 and through similarly dimensioned grooves 24 of the main portions 7. The two ends 8 of the collet 6 have narrower grooves in which the lead 22 is clamped by the helical spring 21 and the orifice 20. In the relaxed condition of the rubber tube 16, its bore has a smaller cross section than the lead 22 so that the tube acts as a friction brake on the lead. The front end of the lead 22 is precisely guided in the metal tube 17 with minimal friction.

When the projecting end of the lead 22 is consumed by writing, the lead is fed forward by depressing the pushbutton 4 until the free ends 8 abut against the shoulder 13, as is shown in FIG. 2, and by thereafter releasing the pushbutton. The ring 15 is taken along with the collet 6 by friction until it abuts against the shoulder 12, and the clamped lead 22 is thus pushed forward against the braking action of the rubber tube 16 until the projections 9 are released by the orifice of the ring 15. When the collet 6 is returned to the illustrated position by the spring 21 after release of the pushbutton, full clamping pressure is not restored until the ring 15 abuts against the collar 3 of the barrel 1, and there is only minimal rearward movement of the lead 22 which is held by the braking tube 16, as is conventional in itself.

The pencil is disassembled by first unscrewing the front piece 2. The pushbutton 4 then may be depressed beyond the position shown in FIG. 2 until the several turns of the spring 21 abut axially against each other. The spring is selected so that the ribs 10 of the collet 6 clear the grooves 19 when the pushbutton is fully depressed to the position shown in FIG. 3. Axial blind bores 23 in the wall of the ring 15 (FIGS. 4 and 5) are thereby exposed and may be engaged by the ends of a bent piece of spring wire or other suitable tool to extract the ring 15 from the bore of the barrel 1 and to turn it 90° from its normal operating position so that it can be slipped over the ribs 10 and projections 9. Thereafter, the receptacle 5 together with the collet 6, the spring 21, and the pushbutton 4 may be withdrawn rearward from the barrel 1.

The steps described in the preceding paragraph are performed in reversed order in assembling the pencil of the invention. The pushbutton 4 and spring 21 are first slipped over the plastic molding consisting of the receptacle 5 and the collet 6 while the molding is held with the collet directed upward. The barrel 1 is next slipped over the molding, and the pushbutton 4 is pressed inward of the barrel bore until a position corresponding to that of FIG. 3 is reached. Thereafter, the ring 15 is inserted into abutting engagement with the collar 3, the ribs 10 are aligned with the grooves 19, and the pushbutton is released. Assembly is completed by screwing the front piece 2 into the front end of the barrel 1. A lead may then be inserted into the tube 17 from the receptacle 5 after removal of the pushbutton 4. These assembly steps are so simple that they readily lend themselves to automatic operation in an obvious manner.

A collet having two halves is commonly accepted in mechanical pencils, but a unitary collet consisting of more than two collet members may be substituted in the illustrated embodiment of the invention without significant change in function. Three collet members are specifically contemplated, and their free ends jointly will assume a non-circular, joint, cross-sectional shape different from that of the ends 8 in the clamping position of FIGS. 1 and 2. An angular movement of 60° may be more appropriate in this instance between the relative positions of ring 15 and collet 6 in which the ring prevents and permits axial passage of the collet than the 90° turn described with reference to the illustrated pencil. The corresponding changes in the configuration of the ring 15 will be obvious.

A pushbutton as shown at 4 is preferred and simplest in a pencil of the type described, but axial movement of the collet 6 may be brought about by other conventional actuating devices accessible outside the barrel 1.

Features of the collet 6 and of the ring 15 may be interchanged. While ribs 10 on the collet 6 have been shown to cooperate with grooves 19 in the ring 15, the same guiding function may be achieved by a projection on the inner face of the ring engaging respective grooves in the collet in each of the two angular positions of the latter, or cooperating with only one groove in the position of FIG. 4.

The axial movement of the collet 6 necessary for disengaging the ribs 10 and grooves 19 is prevented in the illustrated pencil, when fully assembled, by an abutment face on the shoulder 13 of the front piece 2, which acts as a closure member for the front end of the barrel 1. However, a manually releasable abutment for limiting axial movement of the collet may be provided at the other axial end of the barrel, such as a spring loaded radial pin received in a slot of the receptacle 5.

It should be understood, therefore, that the foregoing disclosure relates only to a preferred embodiment, and that it is intended to cover all changes and modifications of the example of the invention herein chosen for the purpose of the disclosure which do not constitute departures from the spirit and scope of the invention set forth in the appended claims.

What is claimed is:

1. A mechanical pencil comprising:

(a) a tubular barrel having an axis, a front end and rear end spaced apart in the axial direction;

(b) a front piece removably secured in the front end of said barrel and forming a stop surface therein extending transversely of the axial direction of said barrel;

(c) collet means located in said barrel and extending in the axial direction thereof;

(1) said collet means including an axially elongated tubular storage receptacle extending in the axial direction of said tubular barrel, a plurality of axially elongated collet members formed integrally with and extending in the axial direction of said receptacle from the end thereof closer to the front end of said tubular barrel toward the front end thereof, each said collet member having a first, axially extending terminal portion with said first portions fixedly fastened together and to said receptacle and a second axially extending terminal portion movable transversely of the axis of said barrel toward and away from a clamping position contiguously adjacent the second portion of each other said collet member, (2) said second portions each having an axially extending inwardly facing surface directed toward the axis of said barrel and an oppositely directed axially extending outwardly facing surface with the outwardly facing surfaces having a generally circular cross-section with an outwardly extending projection extending in the axial direction of said second portions and having a non-circular cross section and with said projections flaring outwardly in the axial direction toward the front end of said barrel when in said clamping position, (3) the inwardly facing surfaces of said collet members, when in said clamping position, being dimensioned for clamping an axially elongated lead therebetween;

(d) actuating means accessible outside said barrel at the rear end thereof for axially moving said collet means in the axial direction thereof within said barrel;

(e) a clamping ring being axially displaceably positioned within said barrel and having an axial bore laterally encircling the axis of said barrel and said second portions when said collet members are in the clamping position, said bore having a generally circular cross-section with a portion of said bore having a non-circular cross section, (1) said collet members extending through said bore in said clamping ring, (2) said portion of said bore being dimensioned for the axial passage of said second portions through said ring in a first angular position about said axis of said barrel of said collet means relative to said ring while preventing the axial passage of said second portions relative to said ring in a second angular position of said collet means and of said ring, (3) said bore having an orifice at the end of said clamping ring closer to the front end of said barrel with at least a portion of said bore forming the orifice flaring in said axial direction corresponding to the flaring of said projections on said second portions and conforming to the shape of said projections for abuttingly receiving said projections of said second portions and holding the received said projections in said clamping position when said collet means are in a predetermined axial position and in said second angular position; and (f) cooperating guide means on said collet members between said first and second axially terminal portions and in said bore of said ring for maintaining said collet members in said second angular position during movement of said collet members from said predetermined axial position in said axial direction over a first distance with said first distance being limited by said stop surface in the front piece while with said front piece removed said collet members can be moved to a second distance from said predetermined axial position greater than the first distance whereby said guide means on said collet members and on said ring are axially displaced out of cooperating relation so that relative angular movement between said collet members and said ring from said second angular position to said first angular position can be effected.

2. A pencil as set forth in claim 1, wherein the surface in said bore has a first face, and said collet members adjacent said second portion include a second face directed outwardly away from the axis thereof and received in said bore during said movement of said collet members from said predetermined axial position over said first distance, said cooperating guide means comprises that one of said first and second faces being formed with an axially extending groove therein, and the other one of said faces having a rib-like projection thereon slidably engaged in said groove and preventing relative angular movement therebetween.

3. A pencil as set forth in claim 1, wherein said ring has a first face in the surface of said bore, said cooperating guide means comprises that said first face being formed with an open guide groove extending in the axial direction of said ring, and at least one of said collet members includes a rib-like projection extending in the axial direction thereof received in said guide groove during movement of said collet member over said first distance.

4. A pencil as set forth in claim 3, wherein said actuating means including a pushbutton axially projecting from said barrel and attached to the end of said receptacle adjacent to the rear end of said barrel, and an axially elongated spring located within said barrel and supported at one end on said barrel and at the other end on said receptacle for biasing said receptacle and pushbutton against movement axially into said barrel.

* * * * *